US006080040A

United States Patent [19]

Appel et al.

[11] Patent Number: 6,080,040

[45] Date of Patent: Jun. 27, 2000

[54] WAFER CARRIER HEAD WITH INFLATABLE BLADDER AND ATTACK ANGLE CONTROL FOR POLISHING

[75] Inventors: Gregory A. Appel, San Francisco; Ethan C. Wilson; Shou-sung Chang, both of Sunnyvale, all of Calif.

[73] Assignee: Aplex Group, Sunnyvale, Calif.

[21] Appl. No.: 08/965,033

[22] Filed: Nov. 5, 1997

[51] Int. Cl.[7] ..... B24B 49/00

[52] U.S. Cl. ..... 451/10; 451/288; 451/387

[58] Field of Search ..... 451/10, 5, 288, 451/388, 387

[56] References Cited

U.S. PATENT DOCUMENTS

| | | | |
|---|---|---|---|
| 5,205,082 | 4/1993 | Shendon et al. | 51/283 R |
| 5,558,568 | 9/1996 | Talieh et al. . | |
| 5,571,044 | 11/1996 | Bolandi et al. | 451/385 |
| 5,584,751 | 12/1996 | Kobayashi et al. | 451/288 |
| 5,593,344 | 1/1997 | Weldon et al. . | |
| 5,624,299 | 4/1997 | Shendon | 451/28 |
| 5,635,083 | 6/1997 | Breivogel et al. | 216/88 |
| 5,681,215 | 10/1997 | Sherwood et al. | 451/388 |
| 5,738,568 | 4/1998 | Jurjevic et al. | 451/41 |
| 5,762,539 | 6/1998 | Nakashiba et al. | 451/41 |
| 5,795,215 | 8/1998 | Guthrie et al. | 451/286 |
| 5,803,799 | 9/1998 | Volodarsky et al. | 451/288 |
| 5,820,448 | 10/1998 | Shamouilian et al. | 451/287 |

*Primary Examiner*—Timothy V. Eley
*Assistant Examiner*—Dung Van Nguyen
*Attorney, Agent, or Firm*—Skjerven, Morrill, MacPherson, Franklin & Friel LLP; David T. Millers

[57] ABSTRACT

A carrier head that holds an object such as a wafer for a polishing system can be rotated during polishing. One such carrier head includes a sensor that determines the relative orientation of (or the angle between) a movable chuck and a fixed drive structure. A control system uses these measurements to select the edge pressure applied to the wafer or the chuck to control the attack angle of the wafer against polishing pads. By actively adjusting the attack angle, a carrier head can accommodate torques about an axis not in the plane of contact between the wafer and the polishing pad even when the wafer is otherwise free to rotate about the axis. One carrier head includes a drive plate with projections ending with balls that are disposed in matching openings in a carrier plate. Radial elongation of openings and curvature of the balls permit rotation of the carrier plate about an axis in plane passing between the carrier and drive plates. Another aspect of the invention provides a flexible bladder connected to a conduit formed in a drive shaft of the carrier head. A wafer is mounted adjacent the bladder so that pressure from the conduit causes the bladder to expand and apply a uniform pressure to the wafer for polishing.

20 Claims, 6 Drawing Sheets

WAFER CARRIER HEAD WITH INFLATABLE BLADDER AND ATTACK ANGLE CONTROL FOR POLISHING

BACKGROUND

1. Field of the Invention

This invention relates to polishing tools and to methods and devices for controlling the orientation of a wafer during polishing.

2. Description of Related Art

Chemical mechanical polishing (CMP) in semiconductor processing polishes the surface of a wafer by removing the highest points from the surface. CMP systems can polish unprocessed and partially processed wafers. A typical unprocessed wafer is crystalline silicon or another semiconductor material that is formed into a nearly circular wafer. A typical partially processed wafer when ready for polishing has a top layer of a dielectric material such as glass, silicon dioxide, or silicon nitride or of a conductive material such as copper or tungsten overlying one or more patterned layers that create local topological features of heights on the order of about 5000 Å to 10,000 Å. Polishing smoothes the local features of the surface. Ideally, the surface after polishing is flat over areas the size of a die to be formed from the wafer. Currently, polishing is sought that locally planarizes wafers to a tolerance of about 3000 Å over the area of a 10×10-mm die.

FIG. 1 illustrates a known chemical mechanical polishing system 100 that includes a wafer carrier head 110 on which a wafer 120 is mounted, a belt 130 carrying polishing pads, and a support 140 that supports belt 130 under wafer 120. During polishing, the polishing pads are sprayed or coated with a slurry, and a drive system 150 rotates belt 130 so that the polishing pads slide against the surface of wafer 120. Chemical action of the slurry and the mechanical action of particles in the slurry and the polishing pads against the surface of wafer 120 remove material from the surface. For uniform removal of the highest points on wafer 120, wafer 120 should be kept parallel to the polishing pads during polishing. However, motion of belt 130 causes friction between wafer 120 and the polishing pads that creates a torque that tends to tilt wafer 120 relative to the polishing pads. Tilting wafer 120 can result in uneven polishing where more material is removed from one edge of wafer 120.

U.S. Pat. Nos. 5,593,344 and 5,558,568 describe systems such as shown in FIG. 1 and further describe a fluid bearing in carrier head 110 for adjustment of the attack angle of wafer 120 at belt 130. The fluid bearing allows the head to adjust so that a wafer is parallel to polishing pads. To avoid tilting, the axis of rotation of the fluid bearing in carrier head 110 is in or nearly in the plane of the pads so that torques created by frictional forces about the bearing's axis of rotation is nearly zero. The constraint that the attack-angle-adjustment axis of rotation be in the plane of the pads significantly restricts carrier head design.

Another concern for carrier heads is the profile of the pressure applied to a wafer (or polishing pad) during polishing. To polish a surface to the tolerances required for semiconductor processing, CMP systems attempt to apply a polishing pad to a wafer with uniform pressure. Accordingly, it is desired that carrier head 110 and support 140 apply uniform pressure across wafer 120 and across the area of belt 130 under wafer 120. A wafer carrier head is sought that applies a uniform pressure to a wafer, aligns the surface of the wafer with the surface of the polishing pads, and avoids tilting the wafer when polishing applies a frictional force to the wafer.

SUMMARY

In accordance with the invention, a carrier head holds and rotates an object such as a wafer during polishing. In one embodiment, a carrier head includes a position sensor that determines the relative orientation of (or the angle between) a movable chuck or carrier for a wafer and a fixed drive structure for connection to a drive motor. A control system for a polisher uses measurements from the sensor to select the edge pressures applied to the chuck to control the attack angle of the object against polishing pads. Actuators or air cylinders mounted on the carrier head can apply the edge pressure to the chuck. Continuously changing the edge pressure changes the relative orientation of the drive structure and the chuck but maintains orientation of the object relative to polishing pads.

One method for using a carrier head applies pressure or force to the chuck to seat the object held by the chuck against polishing pads while the carrier head is at rest. The relative orientation of or angle between the chuck and the drive structure is then determined and recorded for later use. While the carrier head rotates during polishing of the object, a control system continually monitors the relative orientation of the chuck and the drive structure, compares the orientation to the recorded orientation, and changes the edge pressure as required to maintain the attack angle of the object on the polishing pads. Since the carrier head is rotating, the location of maximum edge pressure moves in approximate synchronization with the rotation of the carrier head. By actively adjusting the edge pressure, a carrier head can accommodate torques about an axis not in the plane of contact between the object and the polishing pad even when the chuck is otherwise free to rotate about the axis.

One carrier head includes a drive structure with projections, each having a ball at the end. The drive structure attaches to a chuck through links and through the projections which are inserted in matching openings in the chuck. The balls contact the walls of the openings so that the drive structure and chuck rotate together, about the rotation axis of the carrier head. However, the links and projections allow adjustment of the distance and angle between the drive structure and the chuck. In particular, radial elongation of the openings and curvature of the balls permit a limited range of rotation of the carrier about an axis in a plane passing between the chuck and the drive plate.

Another aspect of the invention provides a flexible bladder connected to a conduit formed in a drive shaft of the carrier head. A wafer is mounted adjacent the bladder so that pressure from the conduit causes the bladder to expand and apply a pressure to the wafer for polishing. The conduit being in the drive shaft allows rotation of the carrier head while the bladder is inflated.

BRIEF DESCRIPTION OF THE DRAWINGS

Use of the same reference symbols in different figures indicates similar or identical items.

DETAILED DESCRIPTION OF THE PREFERRED EMBODIMENTS

In accordance with an aspect of the invention, a carrier head for a polishing tool such as a chemical mechanical polishing (CMP) system has a drive structure with rounded projections that engage a chuck or carrier on which a wafer or other object is mounted for polishing. The projections transfer torque from the drive structure to the carrier so that the drive structure and carrier rotate as a unit, but the rounding of projections allows angular movement of the carrier relative to the drive structure. Accordingly, the carrier head can orient a wafer parallel to the to a polishing pad by changing the relative angle between the drive plate and the carrier plate. For example, hydraulic or pneumatic pressure applied through a drive shaft of the drive plate to a gap or bladder between the drive structure and carrier can seat a wafer against the polishing pad. Alternatively, actuators can apply the force required to seat the wafer against the polishing pad. In accordance with a further aspect of the invention, sensors determine the relative orientation of the drive structure and the carrier when the wafer is seated against a polishing pad and the carrier head is at rest. In this orientation, the wafer is parallel to the polishing pad. During motion of the polishing pad, a control system monitors the relative orientation the drive structure and the carrier and operates positioners or actuators that apply pressure to the carrier or wafer to keep the wafer parallel to the polishing pads.

Figure 1:
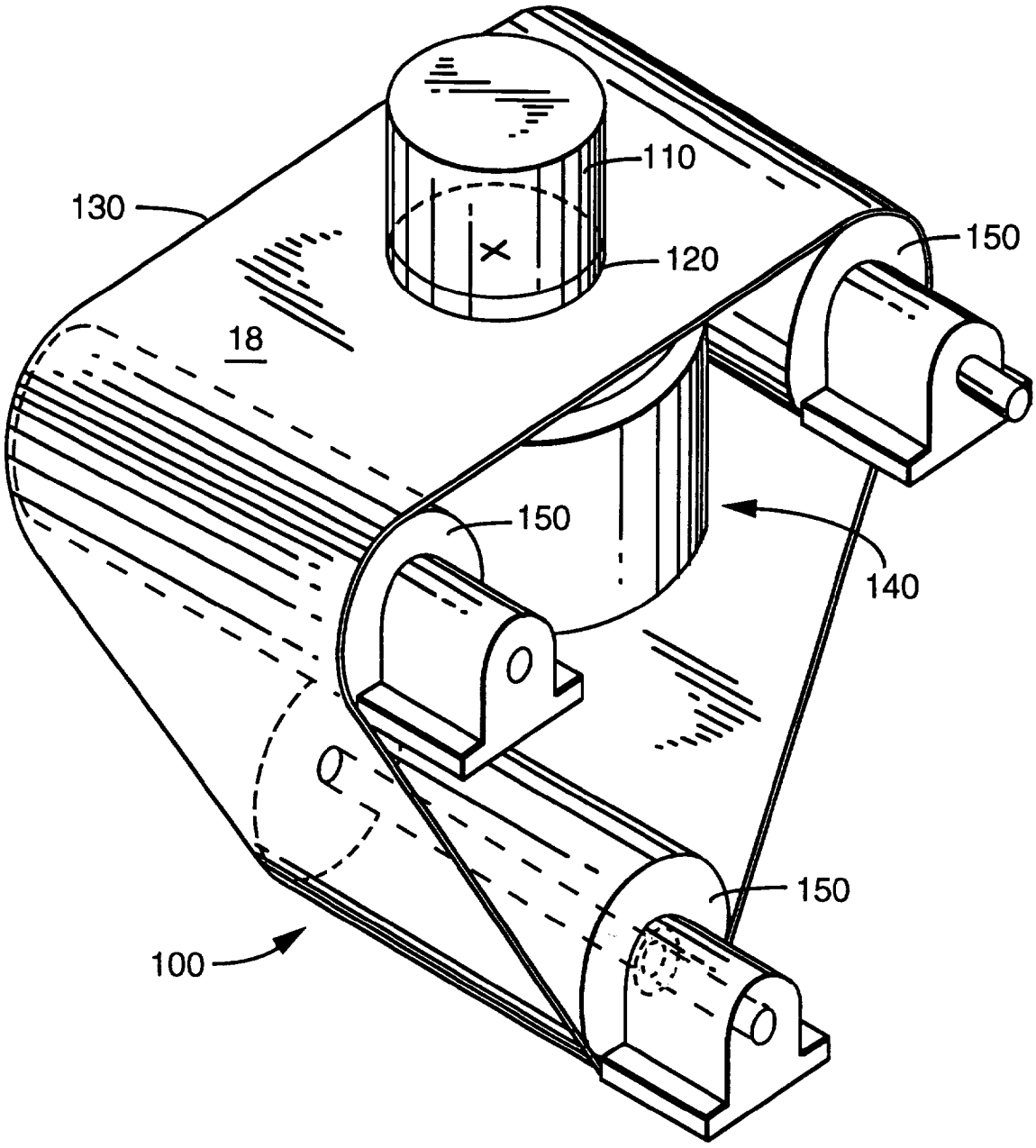
FIG. 1 (PRIOR ART)
FIG. 1 shows a prior art chemical mechanical polishing system.
Figure 2:
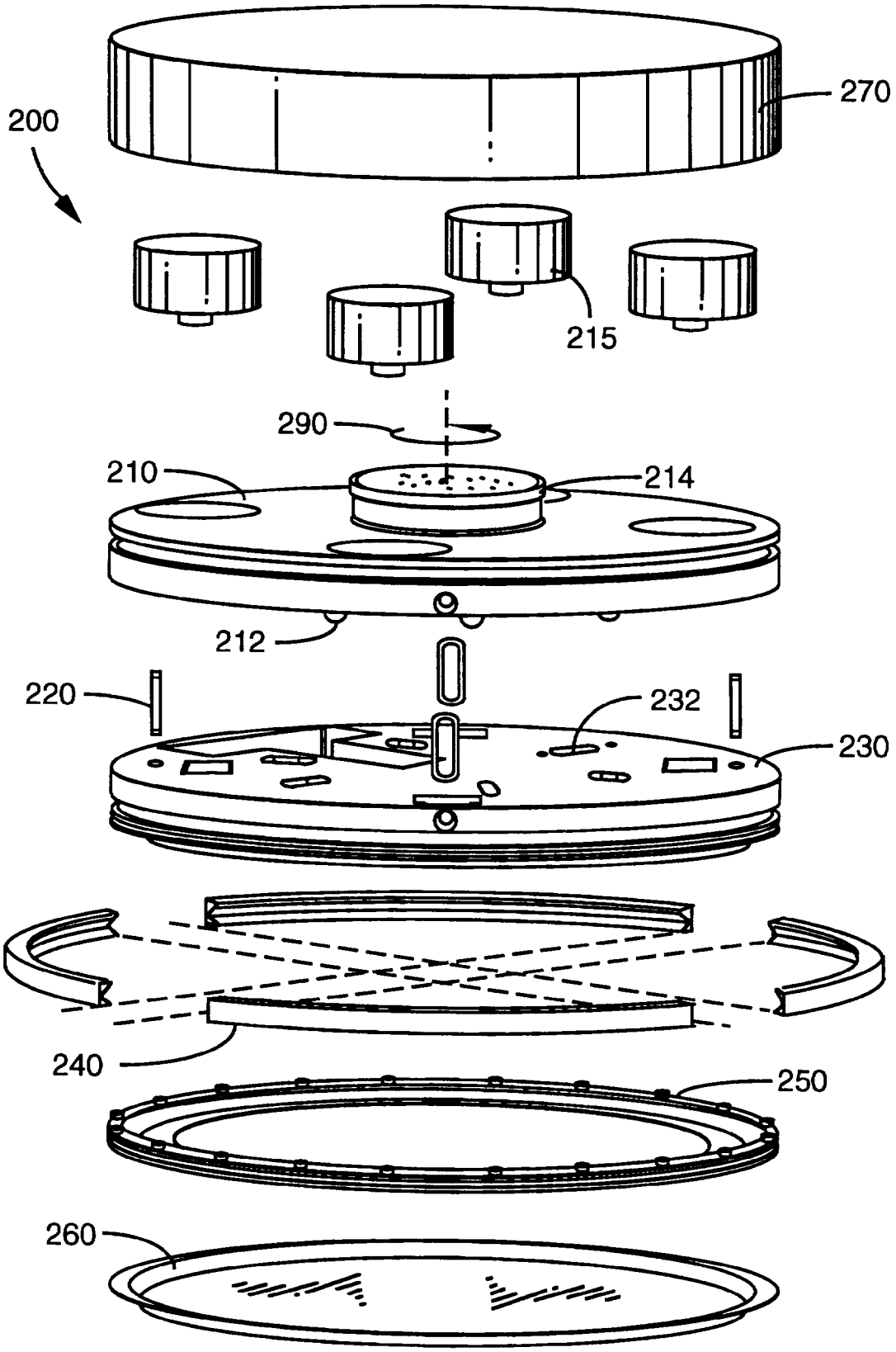
FIG. 2 shows an expanded view of a carrier head in accordance with an exemplary embodiment of the invention.

FIG. 2 shows an expanded view of a carrier head 200 in accordance with an embodiment of the invention. In an exemplary embodiment, carrier head 200 rotates around a rotation axis 290 while holding a wafer against a moving polishing pad. Carrier head 200 can be used in a variety of polishing applications including known CMP systems such as system 100 shown in FIG. 1. Wafer carrier head 200 is also suitable for a system such as described in the co-filed U.S. patent application Ser. No. 08/964,773, entitled "Polishing System Including A Hydrostatic Fluid Bearing Support", and U.S. patent application Ser. No. 08/964,930, entitled "Modular Wafer Polishing Apparatus and Method", which are incorporated by reference herein in their entirety.

Carrier head 200 includes a drive plate 210, a carrier plate 230, a clamp 240, and a retaining ring 250 which are typically made of a metal such as aluminum or stainless steel that is machined to the shape described bellow. In an exemplary embodiment of the invention, plates 210 and 230 and clamp 240 are made of 6061-T6 aluminum and retaining ring 250 is made of a plastic such as PPS. Plates 210 and 230 include slots for four links 220 that attach drive plate 210 to carrier plate 230. To attach drive plate 210 to carrier plate 230, plates 210 and 230 are positioned so that links 220 are in associated slots in both plates 210 and 230 and projections 212 from drive plate 210 are in associated openings 232 in carrier plate 230. Links 220 have elongated openings through which bolts or screws are threaded into drive plate 210 and carrier plate 230. The openings through links 220 are larger than the distance between the bolts when drive plate 210 and wafer carrier 230 are immediately adjacent each other. A flexible cover 270, which is made of fiber reinforced EPDM in the exemplary embodiment, slides around the perimeters of plates 210 and 230 and seals the gap between the plates. Cover 270 is flexible to permit movement of carrier plate 230 away from drive plate 210 until the attachment screws are at opposite edges of the elongated openings in links 220. In the exemplary embodiment of wafer carrier head 200, each link 220 is stainless steel and permits a maximum distance between drive plate 210 and carrier plate 230 of about 0.25 inches at a radius of about 4.25 inches from axis 290.

Rounded projections 212, sometime referred to herein as drive bearings 212, extend from drive plate 210 to engage radially elongated openings 232 in carrier plate 230. Projections 212 may be formed, for example, by pressing spherical ball bearings onto posts attached to drive plate 210. The width of openings 232 is approximately the same as the diameter of the ball portions of projections 212. When drive plate 210 rotates about axis 290, projections 212 contact the sides of openings 232 in carrier plate 230 and cause drive plate 210 and carrier plate 230 to rotate as a unit. However, the rounding of projections 212 and radial elongation of openings 232 permit changes in the relative angle between drive plate 210 and carrier plate 230. For example, one edge of carrier plate 230 can be immediately adjacent drive plate 210, while links 220 allow an opposite edge of carrier plate 230 to be displaced from drive plate 210. An axis for the adjustment of the angle between drive plate 210 and carrier plate 230 is away from the surface of the wafer or pad during polishing.

Mounted on drive plate 210 are four actuators 215 having rods that extend through drive plate 210 to contact carrier plate 230. Actuators 215 apply pressure to carrier plate 230 to maintain carrier plate 230 (or a wafer mounted on carrier plate 230) parallel to the polishing pads. In the exemplary embodiment of the invention, actuators 215 are air cylinders such as the part No. R118x14 available from Compact Air, Inc. Actuators 215 connect to power and/or air pressure via conduits in a drive shaft 214 of drive plate 210. Drive shaft 214 attaches drive plate 210 to a drive motor having matching conduits and connections for maintaining communication of signals or fluids between carrier head 200 and the remainder of a polishing system while carrier head 200 rotates. Each actuator 215 is independently controlled and requires control signals for adjusting the orientation of drive plate 210 relative to carrier plate 230. In the exemplary embodiment of the invention, control circuitry is mounted on carrier plate 230 as described below, but such control circuitry can alternatively be mounted on drive plate 210 or external to carrier head 200. However, exterior mounting of control circuitry may require routing of more signals through drive shaft 214.

Figure 3:
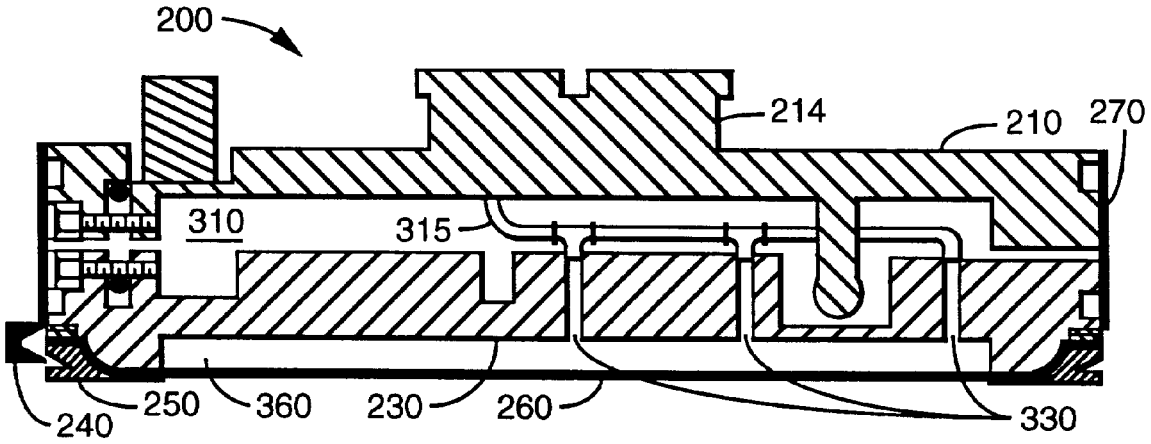
FIG. 3 shows a cross-sectional view of the carrier head of FIG. 2 when assembled.

A flexible bladder 260 attaches to the bottom surface of carrier plate 230 and is held in place by retaining ring 250 and clamp 240 as illustrated in FIG. 3. In the exemplary embodiment, bladder 260 is made of EPDM (ethylene propylene diene monomers). When in place, carrier plate 230 and bladder 260 form a cavity 360 that is sealed except for openings 330 that extend through carrier plate 230. Openings 330 conduct a fluid or gas that pressurize cavity 360, causing bladder 260 to expand. During polishing, a wafer is placed adjacent bladder 260 and within the circumference of retaining ring 250 which stops the wafer from sliding. When cavity 360 is pressurized, bladder 260 expands to push the wafer out to contact the polishing pads, where the wafer is about flush with the bottom edge of retaining ring 250. Bladder 260 thus applies a pressure to the wafer during polishing. Ideally, this pressure is uniform across the area of the wafer.

Figure 4A:
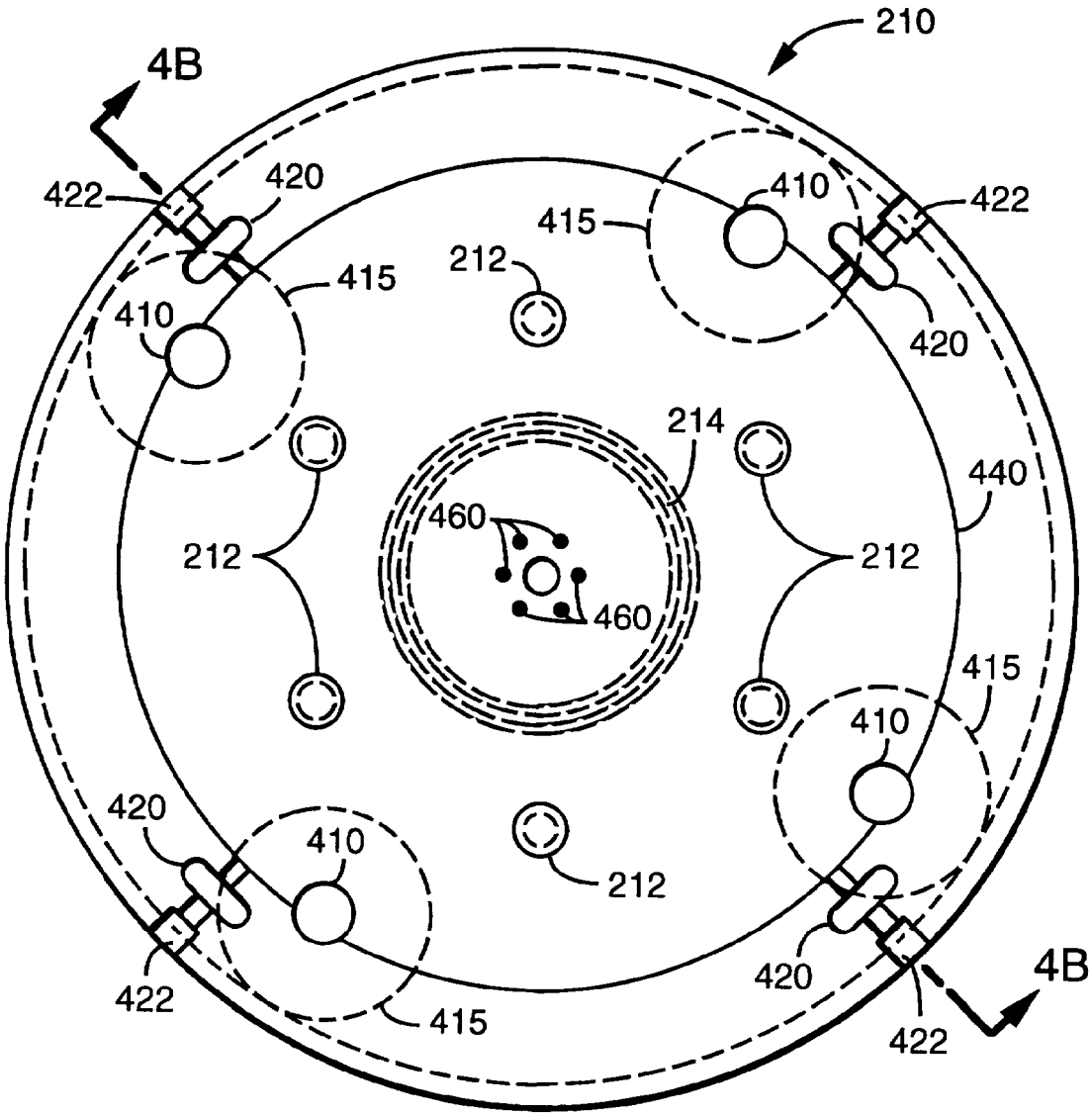
FIGS. 4A and 4B respectively show a transparent bottom view and a cross-sectional view a drive plate for the carrier head of FIG. 2.
Figure 4B:
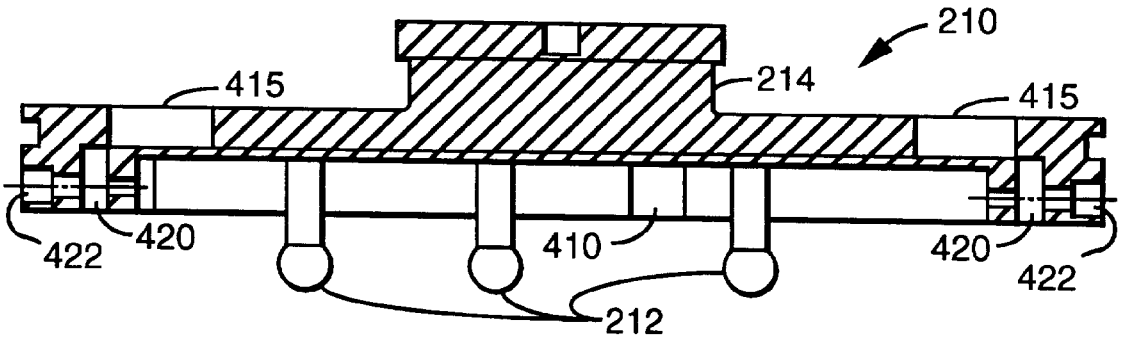

FIGS. 4A and 4B respectively show a transparent bottom view and a cross-sectional view of an exemplary embodiment of drive plate 210. In FIG. 4A, structures shown with dashed lines are not visible from the bottom of drive plate 210. Structures visible from the bottom of drive plate 210 include a depression 440, projections 212, actuator holes 410, slots 420, and conduits 460. Depression 440 provides space for wires, hoses, or tubing that connect to conduits 460. Six projections 212 are uniformly spaced on the circumference of a circle having a radius about half that of drive plate 210 and extend from the bottom of drive plate 210 to engage carrier plate 230. Actuator holes 410 extend through drive plate 210 from counter sunk portions 415, which are on the top of plate 210. Actuators 215, which are mounted in counter sunk portions 415, extend push rods through holes 410 to contact carrier plate 230. Slots 420, which receive links 220 when top plate 210 is attached to bottom plate 230, extend only partially through plate 210. Threaded bolt holes 422 cross associated slots 420 and are for bolts that prevent links 220 from slipping out of slots 420.

Conduits 460 extend through drive shaft 214 of drive plate 210. Drive shaft 214 is for connection to a drive motor that rotates carrier head 200 during polishing. Conduits 460 connect to matching conduits in a shaft of the drive motor and allow flow of gases, fluids, and electric signals to and from carrier head 200. In particular, flexible lines 315, shown in FIG. 3, connect one or more of conduits 460 to inlets 330 for pressurizing cavity 360 and inflating bladder 260. In an alternative embodiment of the invention, bladder 260 includes separate compartments each of which can be connected to a separate inlet 330 and a separate conduit 460 so that each compartment can be inflated to a different pressure. However, it is found that a single cavity is sufficient to provide a suitably uniform pressure to a wafer in contact with bladder 260. In the exemplary embodiment where actuators 215 are air cylinders, one or more of conduits 460 provide pressurized air to the air cylinders. Still other of the conduits 460 are for wiring between control circuitry and/or sensors in carrier head 200 and external circuitry such as a power supply and/or a control or computer system. Another of conduits 460 can provide an inlet to the cavity between drive plate 210 and carrier plate 230.

Figure 5A:
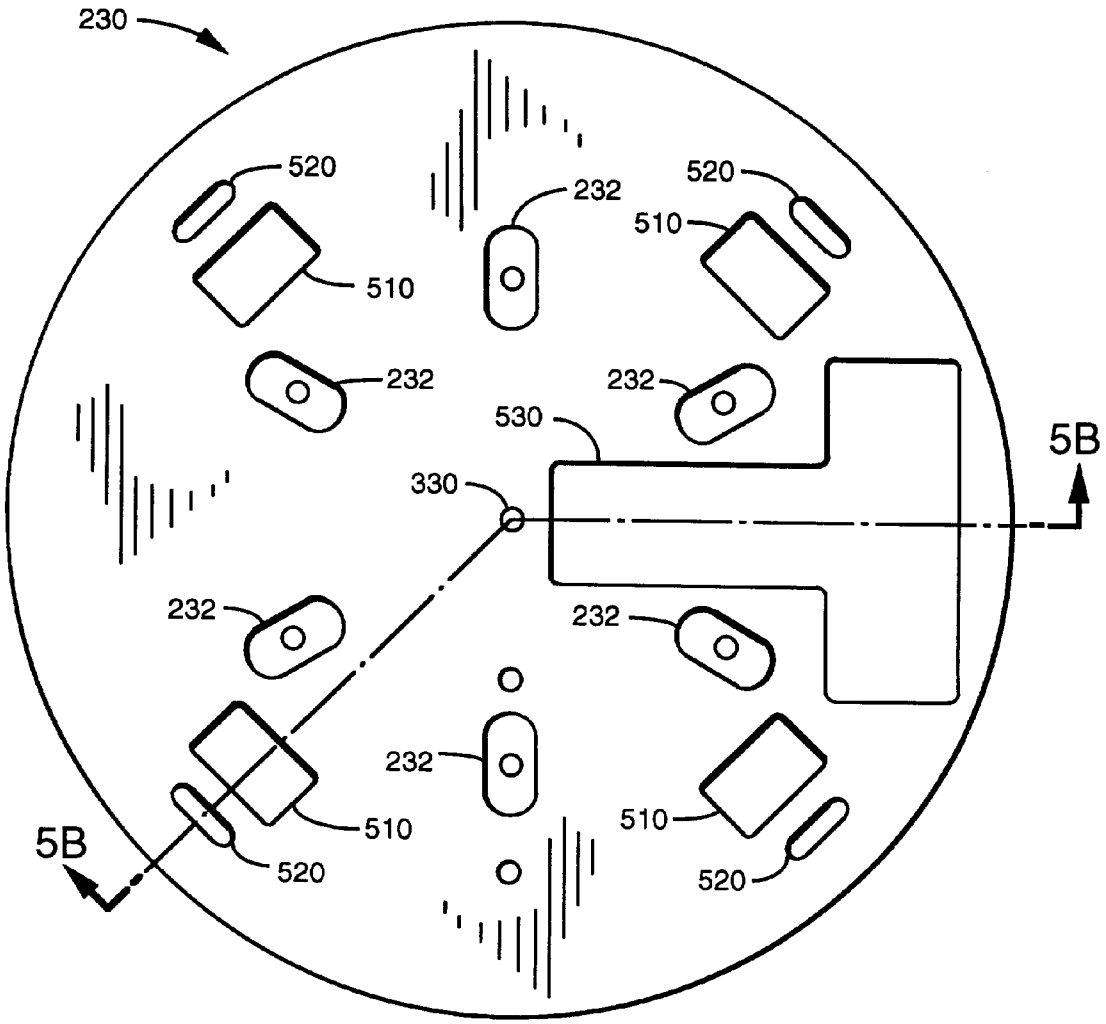
FIGS. 5A and 5B respectively show a top view and a cross-sectional view of a carrier plate for the carrier head of FIG. 2.
Figure 5B:
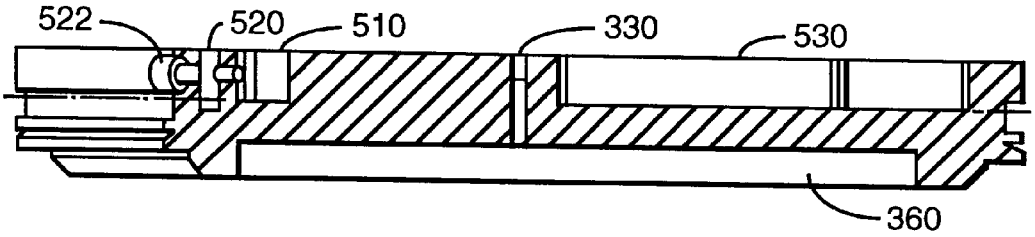

FIGS. 5A and 5B show a top view and a cross-sectional view of carrier plate 230. Visible from the top surface of carrier plate 230 are radially elongated openings 232, slots 520, depressions 510 and 530, and inlets 330. Openings 232 extend only partially through carrier plate 230 and are arranged in a pattern matching the pattern of projections 212 from drive plate 210. Slots 520 receive lower portions of links 220 when carrier plate 230 is attached to drive plate 210. Bolts in bolt holes 522, which are in the side of carrier plate 230, keep links 220 in slots 520 while allowing movement of carrier plate 230 relative to drive plate 210. Inlets 330 pass through carrier plate 230 and provide fluid communication with cavity 360 on the underside of carrier plate 230.

The top surface of carrier plate 230 also includes depressions 510 and 530 which are respectively for mounting of sensors and circuitry in carrier head 200. The sensors in depressions 510 measure distances between carrier plate 230 and drive plate 210 at multiple (four) locations. The measured distances define the current relative orientation of and the angle between the two plates 210 and 230. Circuitry in cavity 530 provides and interface for passing data such as distance measurements from the sensors to a control system. The control system, in the exemplary embodiment is a computer that controls the air pressure fed through conduits 460 to actuators (air cylinders) 215. Software executed by the computer system selects appropriate pressures to keep carrier plate 230 (or more accurately a wafer below carrier plate 230) parallel to a polishing surface. In particular, at the start of a polishing operation, a wafer is placed under carrier plate 230 and carrier head is brought into contact with the polishing surface of polishing pads. Before carrier head 200 begins to rotate, conduits 460 pressurize cavity 360 and a force or pressure is applied to carrier plate 230. Actuators 215 or pressure in cavity 310 pushes plates 210 and 230 apart, and the pressure in cavity 360 inflates bladder 260 to push or seat the wafer against the polishing pads. In this configuration, sensors in depressions 510 measure the reference distances to drive plate 210 when the wafer is properly seated, i.e., the surface to be polished is parallel to and in contact with the surface of the polishing pads. The reference distances indicate the desired orientation of carrier plate 230 relative to the polishing pads and are recorded in the control system. When carrier head 200 begins to rotate, the control system continually monitors the distances as measured by the sensors, compares the measurements to the recorded references, and generates appropriate pressures or control signals for actuators 215. In response, actuators 215 apply pressures that move carrier plate 230 relative to drive plate 210 as required to keep the wafer (and plate 230) parallel to polishing surface.

An advantage of active angle control using sensors is that the active control can keep a wafer parallel to the surface of the polishing pads even when friction causes a torque on carrier plate 230. Carrier head 200 permits rotation of carrier plate 230 relative to drive plate 210 where the axis of rotation is in a plane between plates 210 and 230. Accordingly, friction at the surface of the polishing pads causes a non-zero torque about the possible rotation axes. Active control prevents this torque from tilting the wafer relative to the polishing surface.

Figure 6:
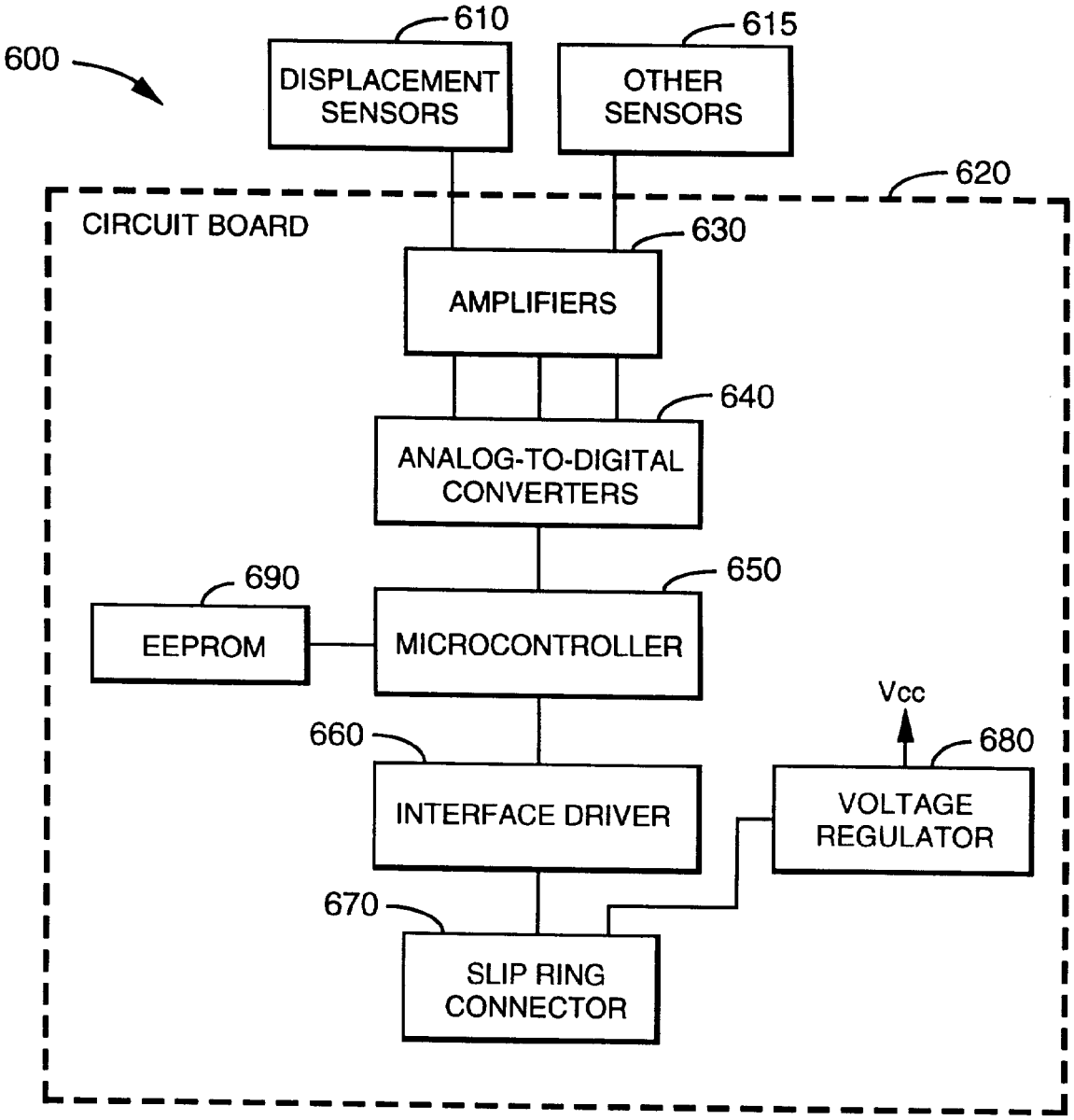
FIG. 6 is a block diagram of circuitry incorporated in a carrier head for data transfer to a control system in accordance with an embodiment of the invention.

FIG. 6 shows a block diagram of circuitry 600 contained in carrier head 200. Circuitry 600 includes displacement sensors 610 and a circuit board 620. Sensors 610 are optical sensors that measure distance between plates 210 and 230 and generate an analog signal indicating the measured distance. In the embodiment of FIG. 5, four displacement sensors in depressions 510 provide four distance measurements that together indicate the orientation of carrier plate 230 relative to drive plate 210. Carrier head 200 may also include other sensors 615 for measuring other properties (e.g., the temperature) of carrier head 200 or a wafer mounted on carrier head 200. Circuit board 620 includes a voltage regulator 680 which receives power via a connector 670 connected to external circuitry through drive shaft 214. Voltage regulator 680 provides the operating voltage Vcc for circuit board 620 and sensors 610 and 615.

A primary purpose of circuit board 620 is to convert data from sensors 610 and 615 to a format that can be transmitted to the external control system using a minimum number of wires. To achieve this purpose, circuit board 620 includes amplifiers 630, analog-to-digital converters (ADCs) 640, a microcontroller 650, an interface driver 660, and connector 670. Amplifiers 630 if necessary, amplify the analog signals from sensors 610 and 615, and ADCs 640 convert the analog signals to digital data signals for microcontroller 640. Microcontroller 650 controls data flow to the external control system through interface driver 660. In the exemplary embodiment, interface driver 660 and microcontroller 650 implement the well-known RS-232 serial interface for communication with the external control system. Data conveyed through the interface includes measurements from sensors 610 and 615 and calibration information stored in an EEPROM 660. The calibration information, which can be written during manufacture of carrier head 200, indicates variations in the geometry or performance of carrier head 200 and/or actuator 215. The external control system reads and uses the calibration information when determining how to operate actuators 215 to keep the wafer parallel to the polishing surface.

Although the invention has been described with reference to particular embodiments, the description is only an example of the invention's application and should not be taken as a limitation. In particular, although an exemplary embodiment of the invention is a carrier head for a CMP belt polisher, other embodiments of the invention can be employed in other polishing tools include, for example, a turntable polisher. Various other adaptations and combinations of features of the embodiments disclosed are within the scope of the invention as defined by the following claims.

We claim:

1. A carrier head for a polishing tool, comprising:

a drive structure;

a chuck movably mounted to the drive plate, the chuck comprising a holder for an object to be polished;

one or more actuators in contact with the chuck, wherein the actuators control orientation of the chuck relative to the drive structure; and a sensor system for sensing the orientation of the chuck.

2. The carrier head of claim 1, wherein the drive structure connects to a drive system that rotates the carrier head, wherein operation of the actuators keeps a surface of the object positioned for polishing while the carrier head rotates.

3. The carrier head of claim 1, wherein movable mounting of the chuck to the drive structure permits rotation of the chuck about an axis outside of a plane in which polishing pads contact the object.

4. The carrier head of claim 1, further comprising:

structure for forming a sealed cavity between the drive structure and the chuck; and a conduit attached the sealed cavity, wherein a flow through the conduit pressurizes the sealed cavity and provides a force pushing the chuck away from the drive structure.

5. The carrier head of claim 1, further comprising a control circuit mounted on the carrier head.

6. The carrier head of claim 5, wherein the control circuit and the sensors are mounted on the chuck.

7. The carrier head of claim 1, wherein the chuck comprises a plate that has a plurality of openings; and the drive structure comprises a plurality of projections, each projection having a rounded portion disposed within a corresponding one of the openings in the plate and engaging a wall of the opening.

8. The carrier head of claim 7, wherein the rounded portion of each projection comprises a ball at an end of the projection.

9. The carrier head of claim 1, wherein the object is a wafer.

10. The carrier head of claim 1, wherein the sensor system senses the orientation of the chuck relative to the drive structure.

11. A polishing tool comprising:

a polishing surface;

a carrier head that comprises:

a drive structure;

a chuck movably mounted to the drive plate, the chuck comprising a holder for an object to be polished;

one or more actuators in contact with the chuck, wherein the actuators control orientation of the chuck relative to the drive structure; and a sensor system for sensing the orientation of the chuck; and a control system connected to the sensor system and to the acturators, wherein the control system receives measurements from the sensor systems and based on the measurements operates the actuators to keep the object positioned against the polishing surface for polishing.

12. A method for polishing an object, comprising:

mounting the objection on a chuck, wherein the chuck is movably mounted on a drive structure;

applying a force to the chuck so as to seat the object in a polishing position against a polishing pad;

determining the orientation of the chuck relative to the drive structure when the object is in the polishing position;

rotating the chuck; and applying a force to the chuck to change the orientation of the chuck relative to the drive structure as required to maintain the object in the polishing position.

13. The method of claim 12, further comprising:

measuring the orientation of the chuck relative to the drive structure while the chuck is rotating; and analyzing measurements of the orientation, wherein applying a force to the chuck comprises applying a force selected according to the analyzing.

14. The method of claim 12, wherein applying a force to the chuck comprises operating actuators that apply a force between the drive structure and the chuck.

15. A carrier head comprising:

a carrier plate that includes a plurality of openings; and a drive plate that comprising a plurality of projections, each projection having a ball at an end of the projection, each ball being disposed within a corresponding one of the openings in the carrier plate and engaging a wall of the opening.

16. The carrier head of claim 15, wherein the drive plate further comprises a drive shaft for mounting to a drive motor during rotation of the carrier head.

17. The carrier head of claim 16, further comprising a flexible bladder attached to the carrier plate, wherein a conduit is disposed in the drive shaft and connected to apply pressure that extends the flexible bladder.

18. The carrier head of claim 17, further comprising a structure for holding a wafer adjacent the flexible bladder, wherein extension of the bladder applies pressure to the wafer.

19. The carrier head of claim 15, wherein the opening in the carrier plate are arranged on a circle perimeter centered on a rotation axis of the carrier head.

20. The carrier head of claim 19, wherein the openings are radially elongated.

* * * * *